US006032633A

United States Patent [19]

Wada

[11] Patent Number: 6,032,633

[45] Date of Patent: Mar. 7, 2000

[54] VERTICAL CRANKSHAFT ENGINE FOR OUTBOARD MARINE ENGINES

[75] Inventor: Tetsu Wada, Wako, Japan

[73] Assignee: Honda Giken Kogyo Kabushiki Kaisha, Tokyo, Japan

[21] Appl. No.: 08/993,741

[22] Filed: Dec. 19, 1997

[30] Foreign Application Priority Data

Dec. 19, 1996 [JP] Japan ..... 8-340075
Feb. 5, 1997 [JP] Japan ..... 9-022877

[51] Int. Cl.[7] ..... F02M 35/10

[52] U.S. Cl. ..... 123/184.24; 123/184.42

[58] Field of Search ..... 123/184.24, 184.34, 123/184.42, 184.47

[56] References Cited

U.S. PATENT DOCUMENTS

| | | | |
|---|---|---|---|
| 5,513,606 | 5/1996 | Shibata | 123/184.34 |
| 5,553,586 | 9/1996 | Koishikawa et al. | 123/184.34 |
| 5,829,402 | 11/1998 | Takahashi et al. | 123/184.24 |
| 5,855,193 | 1/1999 | Takahashi | 123/184.48 |

FOREIGN PATENT DOCUMENTS 4-295170 of 1992 Japan .

*Primary Examiner*—Marguerite McMahon
*Attorney, Agent, or Firm*—Skjerven, Morrill, MacPherson, Franklin & Friel, LLP; Alan H. MacPherson

[57] ABSTRACT

In a outboard marine engine having a vertically oriented crankshaft, an intake manifold assembly which may consist of a one-piece cast member is disposed on one side of the cylinder block, and a throttle body is connected to an upstream end of said manifold assembly. The upstream end of said manifold assembly defines a surge tank, and is provided with a vertically narrowed section, and an elbow section which curves around a corner of the crankcase so that the throttle body is placed opposite an end surface of the crankcase. The elbow section allows the intake system to be accommodated in an outer profile of the engine assembly without any significant protrusion while maximizing the length of the intake system so as to provide the benefits of the inertia of the intake air. The upper and lower surfaces of the narrowed section are attached to a side of the crankcase via L-shaped brackets which are provided with elongated mounting holes which accommodate positional errors that may exist between the manifold assembly and the crankcase.

11 Claims, 7 Drawing Sheets

VERTICAL CRANKSHAFT ENGINE FOR OUTBOARD MARINE ENGINES

TECHNICAL FIELD

The present invention relates to an internal combustion engine having a vertically oriented crankshaft, and in particular to a vertical crankshaft engine suitable for use as an outboard marine engine.

BACKGROUND OF THE INVENTION

An outboard marine engine is desired to have as small an outer profile as possible, and the projection of the intake system of the engine from the outer profile of the outboard marine engine is therefore desired to be minimized.

However, the intake tube needs to have a certain length to maximize the intake inertia effect as a measure to improve the performance of the engine, and a surge tank having a relatively large volume needs to be placed in a part of the intake manifold, where the intake tubes leading to different cylinders merge, to prevent interferences between different cylinders. Thus, the intake system tends to take up a substantial space when the performance of the engine is desired to be improved, and the intake system has been a major factor in preventing a compact design in outboard marine engines.

Japanese patent laid open publication (kokai) No. 4-295170 discloses an arrangement in which the intake tubes extend over the axial length of the cylinders, and a surge tank integrally formed with the intake tubes is secured to a side of the cylinder block by using threaded bolts.

However, the cylinder head, cylinder block and crank case are formed separately, and the flange surface of the intake ports of the engine and the outer surface of the crank case are normally located on different planes. Therefore, the surge tank integrally formed with intake tubes is required to have two separate mounting surfaces, and ensuring the positional precision of the two mounting surfaces with respect to the corresponding mounting surfaces on the cylinder head and the cylinder block presented a major problem. This fact also caused an additional difficulty in assembling the surge tank and intake tube assembly to the engine main body.

SUMMARY OF THE INVENTION

In view of such problems of the prior art, a primary object of the present invention is to provide an internal combustion engine suitable for use as an outboard marine engines which is made compact by minimizing the protrusion of the intake system of the engine from the outer profile.

A second object of the present invention is to provide an internal combustion engine suitable for use as an outboard marine engines which is compact and mechanically sturdy.

A third object of the present invention is to provide an internal combustion engine suitable for use as an outboard marine engine which is compact and easy to manufacture.

According to the present invention, these and other objects can be accomplished by providing a multi-cylinder engine, comprising a cylinder block, a crankcase, a cylinder head, and a crankshaft oriented in a vertical direction, further comprising: a plurality of intake tubes extending from intake ports defined in said cylinder head and along one side of said cylinder block; a surge tank into which upstream ends of said intake tubes merge, said surge tank being disposed on one side of said cylinder block; and a throttle body connected to an upstream end of said surge tank via an elbow section which curves around a corner of said crankcase in such a manner that said throttle body is located opposite an end surface of said crankcase.

The provision of the elbow section allows the intake system to be accommodated in an outer profile of the engine assembly without any significant protrusion while maximizing the length of the intake system so as to provide the benefits of the inertia of the intake air. In view of simplifying the manufacturing and assembling process, the elbow section and/or the intake tubes may be integrally cast with the surge tank.

To ensure a sufficient mechanical strength and rigidity to the intake system, it is preferable to secure an intermediate part of the intake system extending over a substantial length. To meet such a need, the upstream end of the surge tank may include a vertically narrowed section so that an least one of upper and lower surfaces of the narrowed section may be attached to a side of the crankcase via an L-shaped bracket. Preferably the bracket is provided with at least one elongated hole for receiving a threaded bolt for securing the bracket to the surge tank or the crankcase. Thereby, any positional or dimensional errors that may exist in the mounting positions such as the downstream end of the intake tubes, and the bosses that may be provided in the cylinder block or the crankcase and the surge tank may be accommodated by the elongated holes. Also, the threaded bolts for securing the brackets may be passed from two mutually perpendicular directions, accommodating the positional errors can be effected without impairing the work efficiency. To maximize the rigidity and mechanical strength of the arrangement for securing the surge tank, both the upper and lower surfaces of the narrowed section may be attached to a side of the crankcase via a pair of L-shaped brackets.

Engines of this type are normally equipped with a low speed air regulating valve such as an electronic air control valve (EACV), and it can be conveniently attached to a substantially horizontal mounting surface defined in the upstream end of the surge tank without creating any protrusion from the outer profile of the engine assembly. In particular, by orientating the EACV in such a manner that the valve stem extends horizontally, the responsiveness of the EACV may be maximized without being affected by the influences of the gravitational force.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
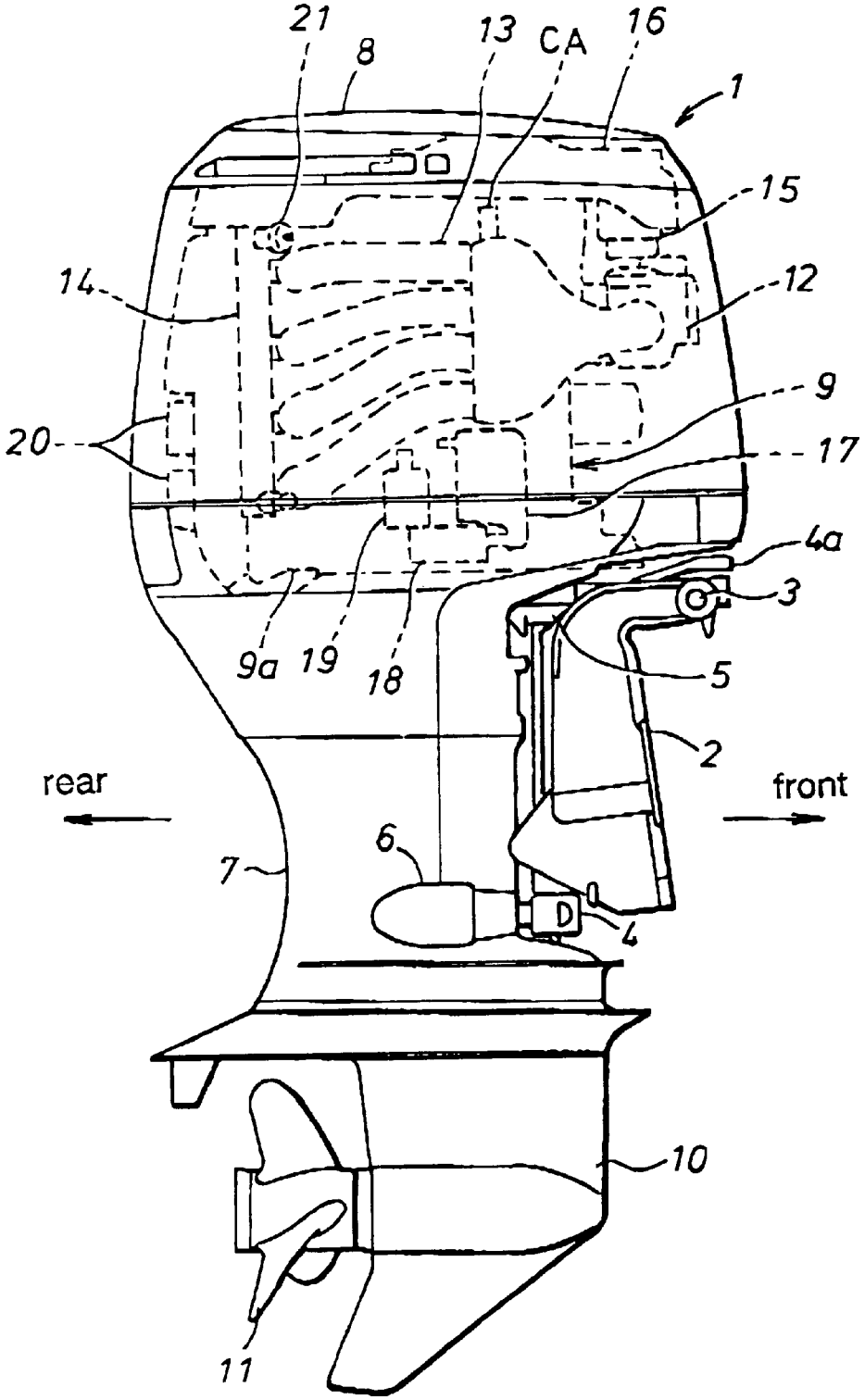
FIG. 1 is a see-through side view of an outboard marine engine assembly embodying the present invention.

FIG. 1 generally illustrates an outboard marine engine assembly 1 embodying the present invention. This outboard marine engine assembly 1 is attached to a stern board of a boat (not shown in the drawing) via a stern bracket 2 equipped with clamping means. To the stern bracket 2 is connected a swivel case 4 so as to be tiltable via a tilt shaft 3 extending laterally and horizontally with respect to the boat. The swivel case 4 is provided with a vertical swivel shaft (not shown in the drawing) to allow the engine main body to be swung laterally for steering the boat. Upper and lower mount arms 5 and 6 extend rearwardly from the swivel case 4, and an extension case 7 accommodating a propeller shaft (not shown in the drawing) is supported by free ends of these mount arms 5 and 6.

A steering arm 4*a* integrally formed with the swivel shaft extends in the forward direction so that the steering of the boat can be accomplished by moving the steering arm 4*a* in either lateral direction via the lateral swinging motion of the engine main body.

An engine 9 is placed above the extension case 7, and is generally covered by an engine cover 8. A gear case 10 supporting a screw propeller 11 is attached to a lower end of the extension case 7.

Figure 2:
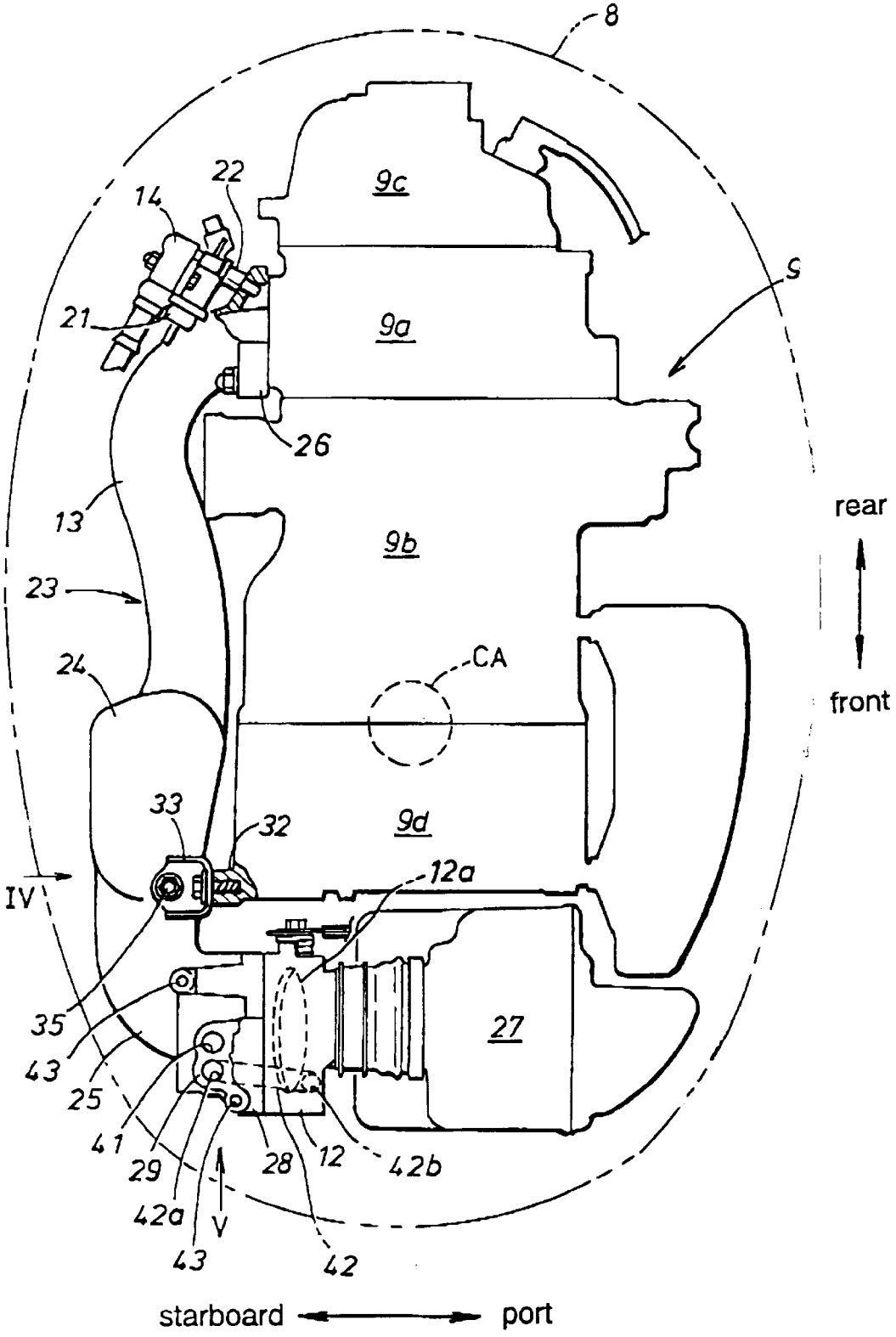
FIG. 2 is a plan view of the outboard marine engine assembly.

The engine 9 consists of a vertical crankshaft engine having a crankshaft CA which is oriented vertically in use, and, in this particular embodiment, consists of a water-cooled four-cylinder, four-stroke engine. A throttle body 12 is placed on the front end of the assembly, and somewhat offset to the starboard side. A manifold assembly 23 extend from a starboard side of a cylinder head 9*a* in a rear end portion of the assembly 1 to the throttle body 12, in the shape of letter L as best illustrated in FIG. 2. The manifold assembly 23 comprises four intake tubes 13 extending from the cylinder head 9*a* and a surge tank 24 which joins the four intake tubes 23 and is connected to the throttle body 12. Preferably, the manifold assembly 23 may consist of a one-piece cast member for simplifying the assembling work. However, it can also be constructed from more than one piece depending on the need of each particular application.

A fuel supply rail 14 extends vertically near the area of interconnection between the intake tubes 13 and the cylinder head 9*a,* and supports fuel injectors 22 provided in the downstream ends of the intake tubes 13, and distributes fuel to these fuel injectors 22. The upper end of the engine 9 is covered by a belt cover 16 for covering a belt (not shown in the drawing) for transmitting power from the crankshaft CA to a generator 15 and a camshaft (not shown in the drawing) of the engine. The lower ones of the intake tubes 13 are curved upward as they extend away from the cylinder head 9*a*. A space is therefore defined under the intake tubes 13 on the starboard side of the engine, and this space accommodates a sub-tank 17, a high pressure fuel pump 18 and a fuel filter 19.

The fuel supplied from a main tank not shown in the drawing is first delivered by a low pressure pump 20 mounted on the rear end of the engine 9 to the sub-tank 17, and via the high pressure pump 18 and the fuel filter 19, forwarded to an end (a lower end) of the fuel rail 14 to be distributed to the respective fuel injectors. The fuel pressure at the fuel injectors is regulated by a regulator 21 mounted on an upper end of the fuel rail 14.

Figure 3:
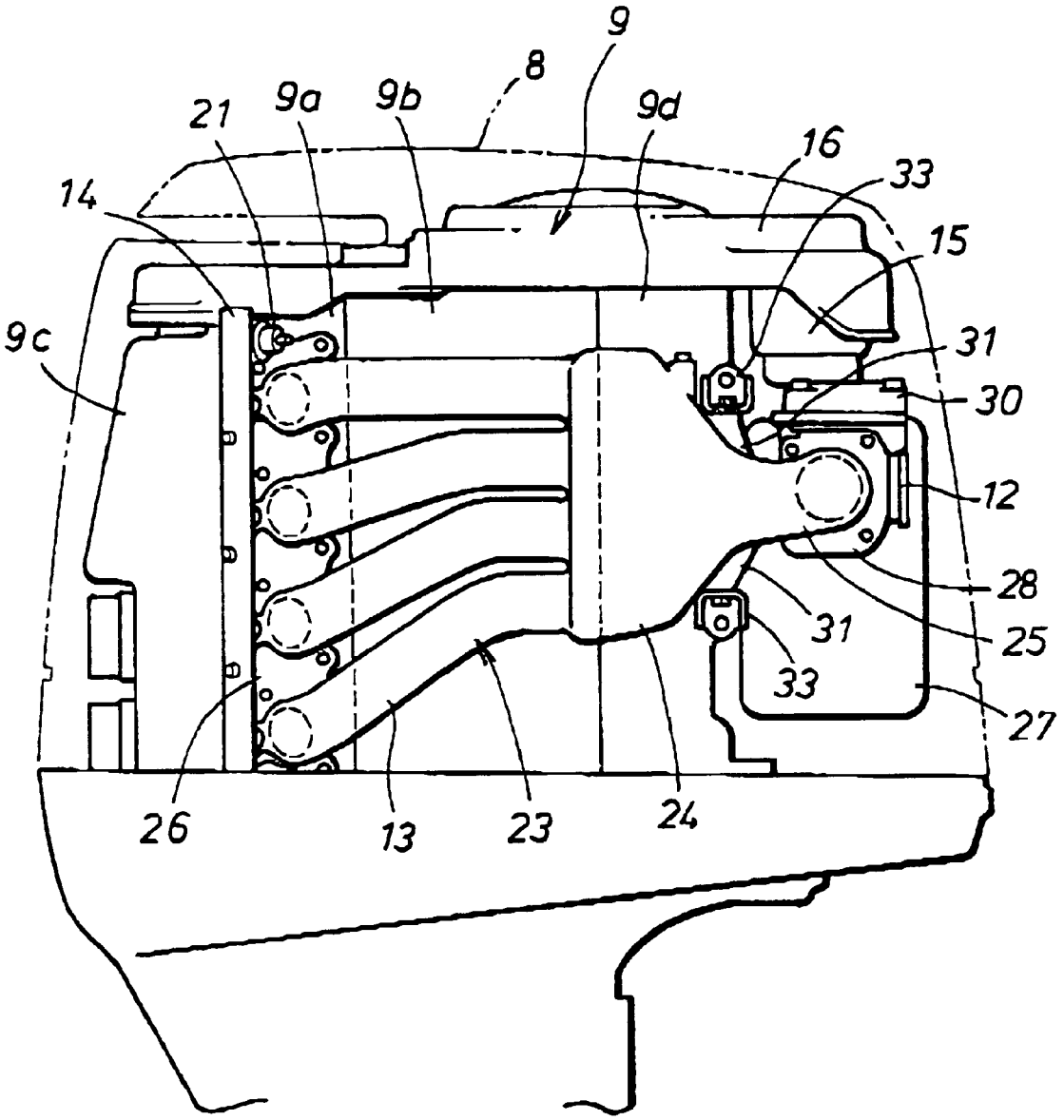
FIG. 3 is a side view of an upper part of the outboard marine engine assembly.

Referring to FIGS. 2 and 3, the engine 9 comprises a cylinder block 9*b*, the cylinder head 9*a* attached to one end of the cylinder block 9*b* so as to define combustion chambers, a head cover 9*c* covering the valve actuating mechanism provided in the cylinder head 9*a*, and a crankcase 9*d* attached to the crankshaft end of the cylinder block 9*b*.

The upstream end of the surge tank 24 is integrally provided with an elbow section 25 which is narrowed from the main part of the surge tank 24 and is curved around the corner of the crankcase 9*d*. To the terminal end of the elbow section 25 is connected the outlet end of a throttle body 12. Thus, the intake manifold assembly 23 extends from the cylinder head 9*a* along one side of the engine, and curves around the corner of the crankcase 9*d*.

The downstream end of each of the intake tubes 13 is provided with a flange 26 for attaching the downstream end of the intake tube 13 to the corresponding intake port of the cylinder head 9*a*. Each of the injectors 22 is attached to the downstream end of the corresponding intake tube 13 by being interposed between an injector mounting hole provided in the flange 26 and the fuel rail 14.

The throttle body 12 has its central axial line extending laterally at the front end of the engine, and the inlet end of the throttle body 12 is connected to a suction chamber 27 which has an air inlet opening directed downward. Thus, the throttle body 12 and the suction chamber 27 are placed so as to oppose the front end of the crankcase 9*d*.

The upstream end of the elbow section 25 of the intake manifold assembly 23 is provided with a flange 28 for attaching the throttle body 12 thereto by using threaded bolts. The upper end of the flange 28 is provided with a planar mounting surface 29 for mounting an EACV 30 thereon. The EACV 30 which is omitted from illustration in FIG. 2 is described hereinafter in more detail.

Figure 4:
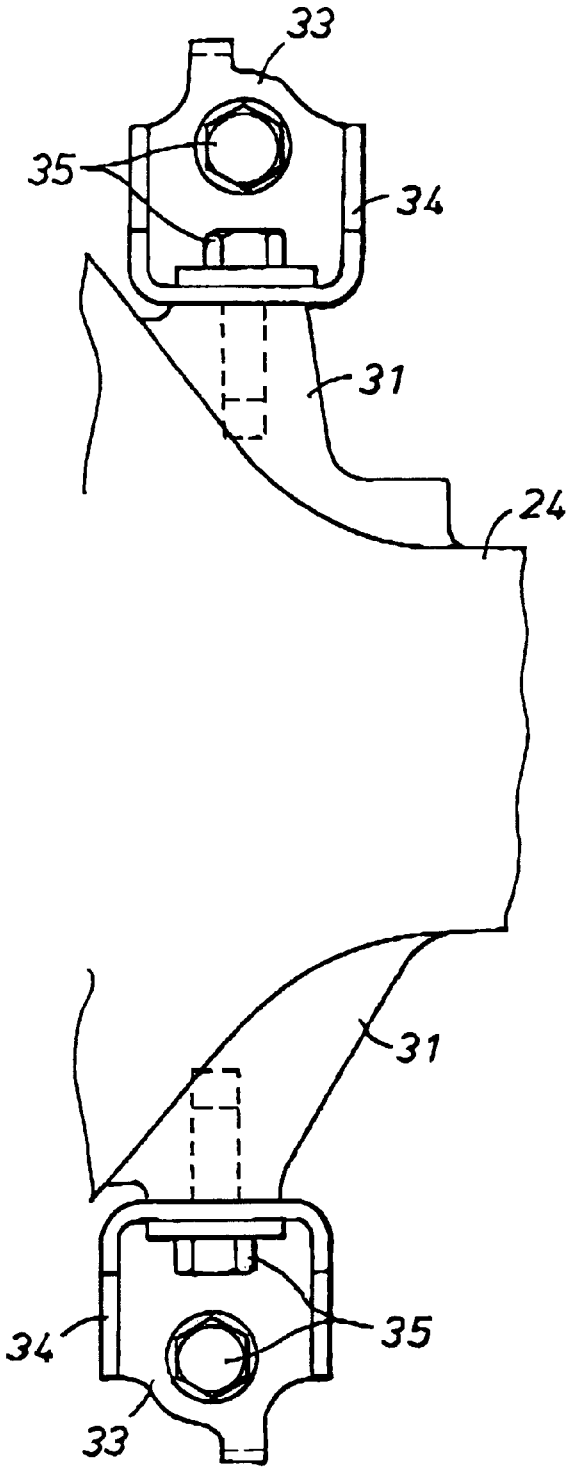
FIG. 4 is an enlarged fragmentary side view as seen from arrow IV of FIG. 2
Figure 5:
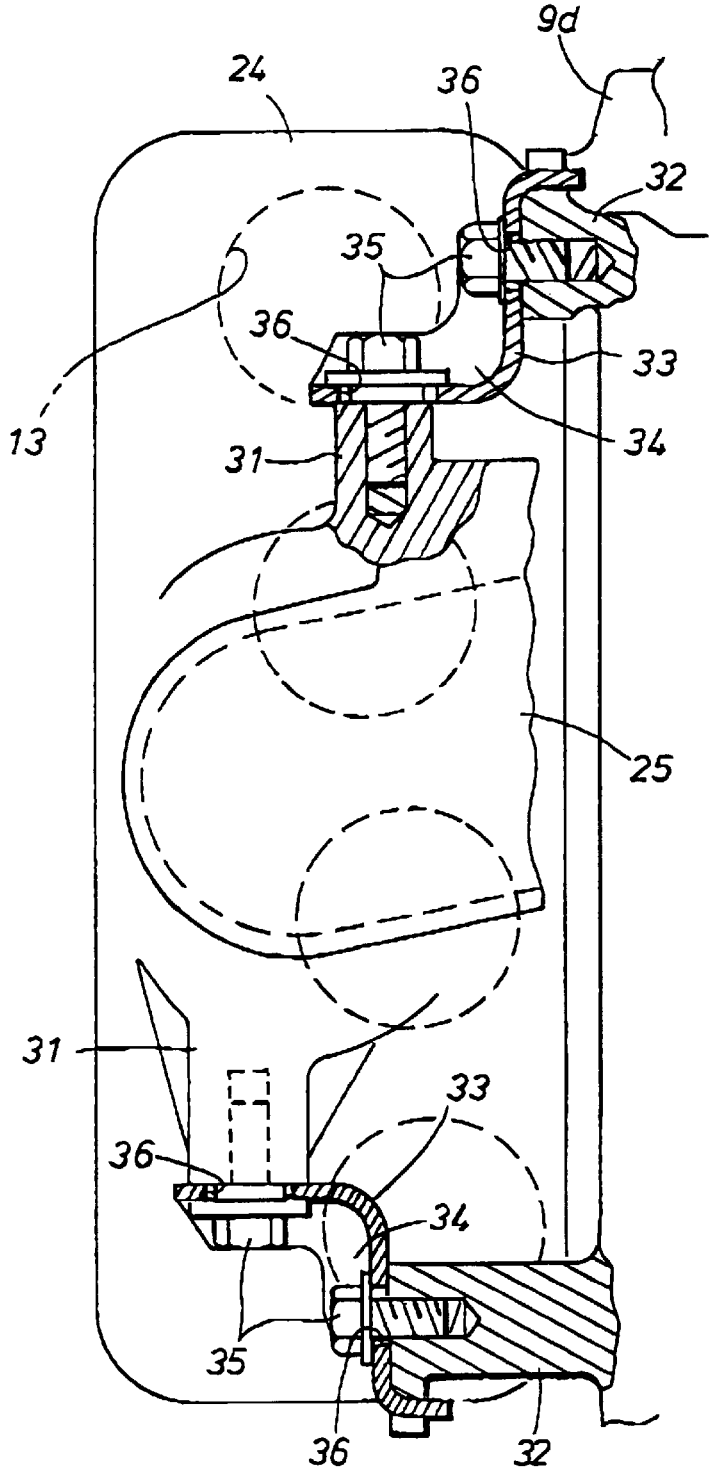
FIG. 5 is an enlarged, partly broken-way fragmentary end view as seen from arrow V of FIG. 2.

As best illustrated in FIG. 4, the narrowing part of the upstream end of the surge tank 24 is integrally provided with a pair of bosses 31 extending from either side thereof or vertically. As best illustrated in FIG. 5, corresponding bosses 32 project laterally from the crankcase 9*d*. The corresponding bosses 31 and 32 are joined by a pair of L-shaped brackets 34 and threaded bolts 35. Each of the brackets 34 is provided with reinforcing ribs 34 on either side thereof, and elongated holes 36 for receiving the threaded bolts 35.

Thus, by passing the threaded bolts 35 through the elongated holes 36 of the brackets 33 and threading them into the threaded bores of the corresponding bosses in mutually perpendicular directions, the surge tank 24 of the intake manifold assembly 23 can be firmly secured to the crankcase 9*d*. The elongated holes 36 can accommodate any positional errors that may be present in the bosses 31 and 32 and the threaded bores.

The EACV mounting surface 29 defined in the upper surface of the flange 28 for the throttle body 12 is provided with an outlet opening 41 for communicating an output port of the EACV 30 with the interior of the manifold assembly 23, and a downstream opening 42*a* for a bypass passage 42 of the throttle body 12 which bypasses a throttle valve 12*a* and communicates the upstream end of the throttle body 12 with the inlet port of the EACV 30. The mounting surface 29 is provided with a pair of threaded holes 43 for receiving threaded bolts for securing the EACV 30 onto the mounting surface 29.

Figure 6:
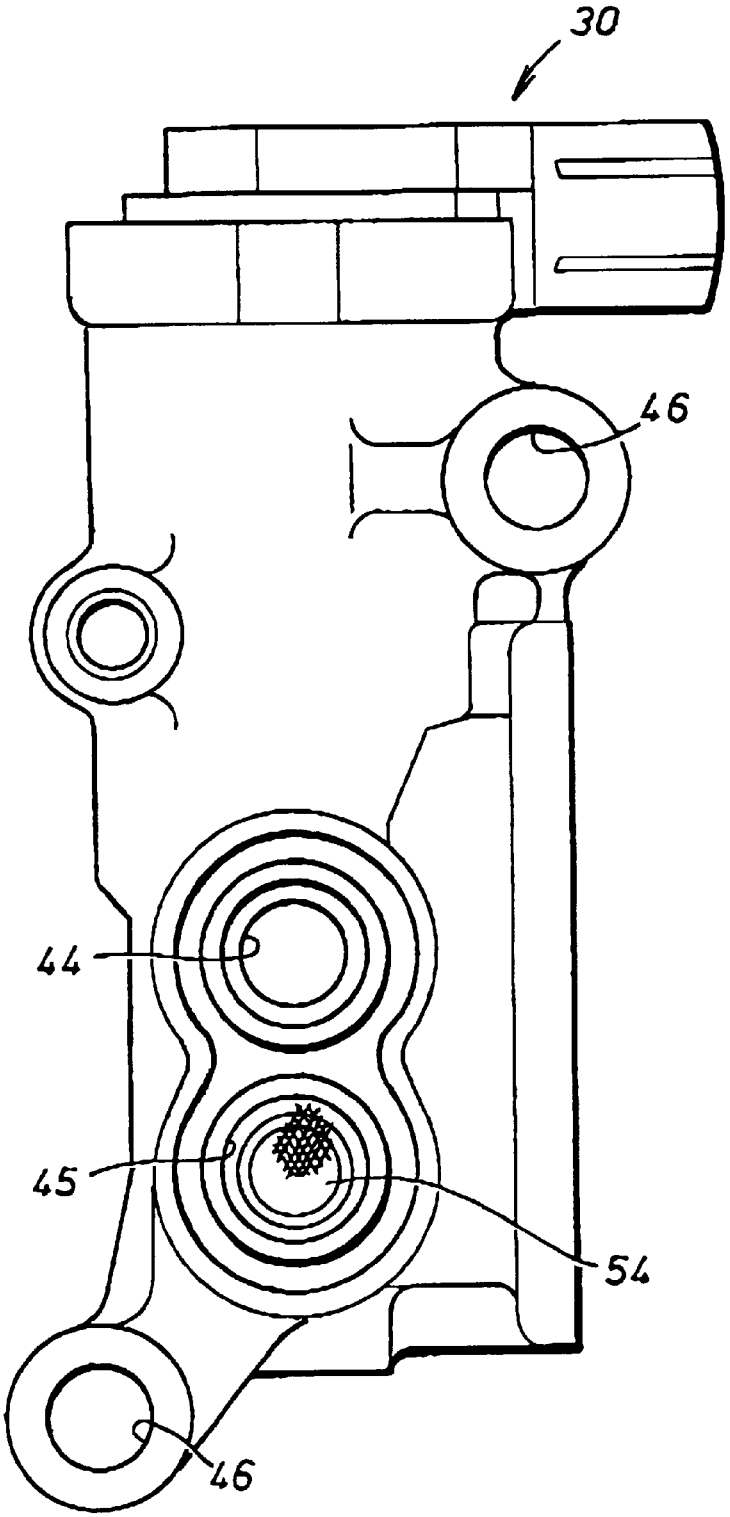
FIG. 6 is a bottom view of the EACV.
Figure 7:
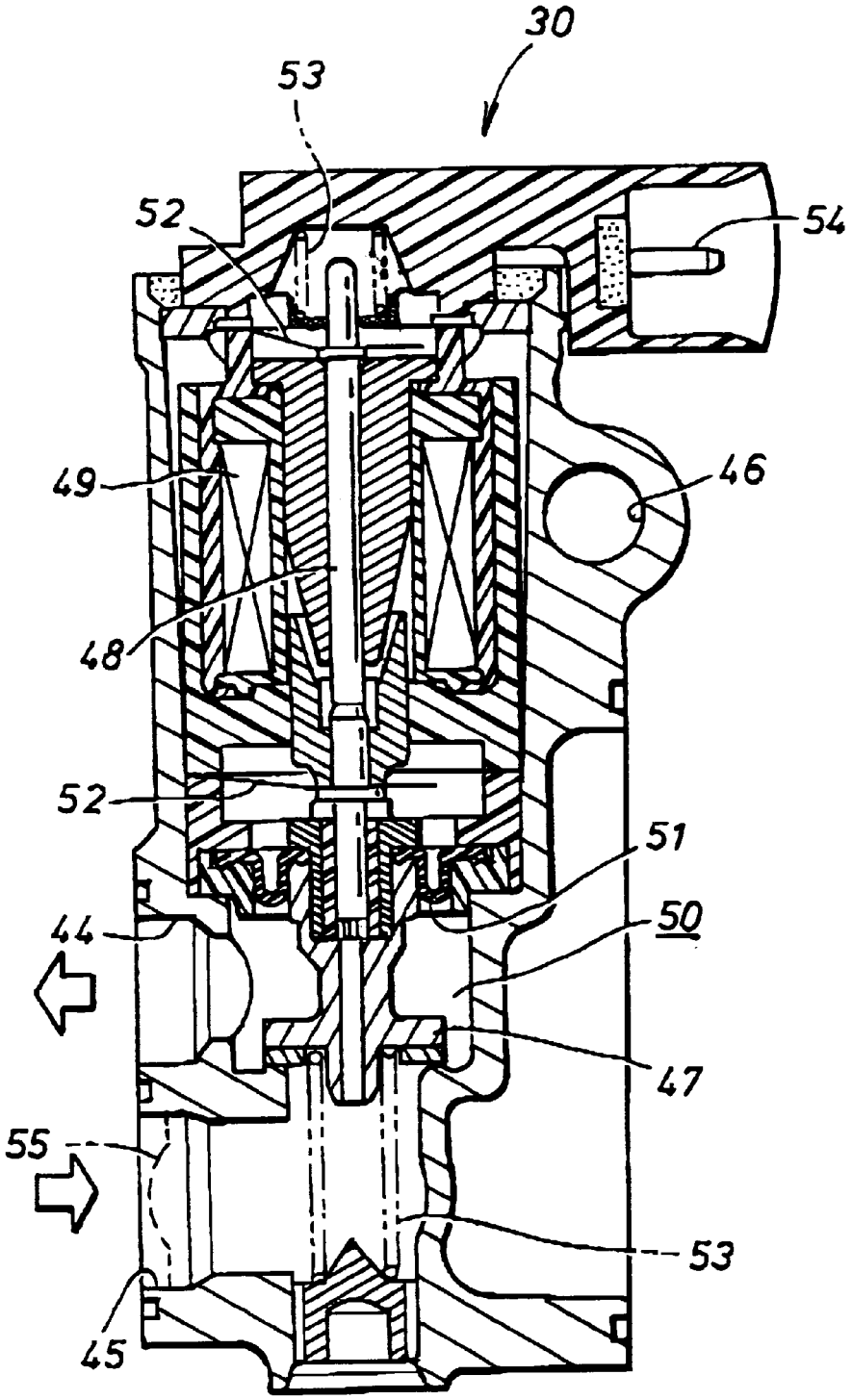
FIG. 7 is a sectional view of the EACV, the left half and the right half showing vertical and horizontal sections of FIG. 6, respectively.

Referring to FIGS. 6 and 7, the casing of the EACV 30 is provided with an output port 44, an input port 45, and mounting holes 46 which correspond to the outlet opening 41, the downstream opening 42*a* and the threaded holes 43, respectively, and is adapted to be mounted onto the mounting surface 29 via a gasket (not shown in the drawing). The EACV 30 thus defines a low speed air passage which bypasses the throttle valve 12*a*.

The EACV 30 by itself is conventional, and comprises a valve member 47 for selectively closing the communication between the input port 44 and the output port 45, a valve stem 48 supporting the valve member 47, and a solenoid unit 49 for actuating the valve stem 48 into opening the valve member 47. A valve chamber 50 receiving the valve member 47 is separated from the interior of the solenoid unit 49 by a diaphragm 51.

The valve stem 48 is supported by a pair of sheet springs 52 so as to be resiliently moveable in the axial direction, but to be relatively rigidly restrained from lateral movement. A pair of compression coil springs 53 normally urge the valve member 47 along with the valve stem 48 in the direction to close the valve member 48. Therefore, the communication between the outlet port 44 and the input port 45 is normally closed, but can be selectively opened at a desired opening by controlling the electric current supplied to the solenoid unit 49 via connector pins 54 by duty ratio control. Thus, the flow rate of the low speed air can be continuously and finely controlled. Numeral 55 denotes a filter provided in the input port 45.

The valve stem 48 is oriented horizontally so that the movement of the valve member is prevented from being affected by the gravitational force, and the EACV 30 can operate in a highly responsive manner. Furthermore, because the elbow section 25 of the intake manifold assembly 23 permits the EACV 30 to be favorably mounted inside the outer profile of the engine assembly as seen from above. Thus, the arrangement proposed by the present invention can achieve both a highly responsive operation of the EACV 30 and compact design at the same time.

Although the present invention has been described in terms of preferred embodiments thereof, it is obvious to a person skilled in the art that various alterations and modifications are possible without departing from the scope of the present invention which is set forth in the appended claims.

What I claim is:

1. A multi-cylinder engine, comprising a cylinder block, a crankcase, a cylinder head, and a crankshaft oriented in a vertical direction, further comprising:

a plurality of intake tubes, all of said intake tubes in said engine extending from intake ports defined in said cylinder head and along one side of said cylinder block;

a surge tank into which upstream ends of said intake tubes merged, said surge tank being disposed on one side of said cylinder block; and a throttle body connected to an upstream end of said surge tank via an elbow section which curves around a corner of said crankcase in such a manner that said throttle body is located opposite an end surface of said crankcase.

2. A multi-cylinder vertical crankshaft engine according to claim 1, wherein said elbow section is integrally cast with said surge tank.

3. A multi-cylinder vertical crankshaft engine according to claim 1, wherein said intake tubes are integrally cast with said surge tank.

4. A multi-cylinder vertical crankshaft engine according to claim 1, wherein said upstream end of said surge tank includes a vertically narrowed section, and at least one of upper and lower surfaces of said narrowed section is attached to a side of said crankcase via an L-shaped bracket.

5. A multi-cylinder vertical crankshaft engine according to claim 4, wherein said upper and lower surfaces of said narrowed section are attached to a side of said crankcase via a pair of L-shaped brackets.

6. A multi-cylinder vertical crankshaft engine according to claim 4, wherein said bracket is provided with at least one elongated hole for receiving a threaded bolt for securing said bracket to said surge tank or said crankcase.

7. A multi-cylinder vertical crankshaft engine according to claim 1, wherein said upstream end of said surge tank includes a substantially horizontal mounting surface for mounting a low speed air regulating valve EACV).

8. A multi-cylinder engine, comprising a cylinder block, a crankcase, a cylinder head, and a crankshaft oriented in a vertical direction, further comprising:

a plurality of intake tubes extending from intake ports defined in said cylinder head and along one side of said cylinder block;

a surge tank into which upstream ends of said intake tubes merge, said surge tank being disposed on one side of said cylinder block; and a throttle body connected to an upstream end of said surge tank;

wherein said upstream end of said surge tank includes a substantially horizontal mounting surface for mounting a low speed air regulating valve (EACV).

9. A multi-cylinder engine, comprising a cylinder block, a crankcase, a cylinder head, and a crankshaft oriented in a vertical direction, further comprising:

a plurality of intake tubes extending from intake ports defined in said cylinder head and along one side of said cylinder block;

a surge tank into which upstream ends of said intake tubes merge, said surge tank being disposed on one side of said cylinder block; and a throttle body connected to an upstream end of said surge tank;

wherein said upstream end of said surge tank includes a vertically narrowed section, and at least one of upper and lower surfaces of said narrowed section is attached to a side of said crankcase via an L-shaped bracket.

10. A multi-cylinder vertical crankshaft engine according to claim 9, wherein said upper and lower surfaces of said narrowed section are attached to a side of said crankcase via a pair of L-shaped brackets.

11. A multi-cylinder vertical crankshaft engine according to claim 9, wherein said bracket is provided with at least one elongated hole for receiving a threaded bolt for securing said bracket to said surge tank or said crankcase.

* * * * *